US007204374B2

(12) United States Patent
Marek

(10) Patent No.: US 7,204,374 B2
(45) Date of Patent: Apr. 17, 2007

(54) TOOL HOLDER

(76) Inventor: James E. Marek, 2323 Clearwater Ct. NE., Rockford, MI (US) 49341

( * ) Notice: Subject to any disclaimer, the term of this patent is extended or adjusted under 35 U.S.C. 154(b) by 344 days.

(21) Appl. No.: 10/753,664

(22) Filed: Jan. 8, 2004

(65) Prior Publication Data

US 2004/0144739 A1 Jul. 29, 2004

Related U.S. Application Data

(60) Provisional application No. 60/438,654, filed on Jan. 8, 2003.

(51) Int. Cl.
*A47F 7/00* (2006.01)

(52) U.S. Cl. ..... 211/70.6

(58) Field of Classification Search ..... 211/70.6, 211/87.01, 88.01, 65, 66, 67, 68, 74, 75; 206/376, 377, 378

See application file for complete search history.

(56) References Cited

U.S. PATENT DOCUMENTS 742,581 A * 10/1903 Burtch ..... 211/65
1,236,085 A 8/1917 Hudnut
3,365,761 A * 1/1968 Kalvig ..... 248/113
4,253,830 A 3/1981 Kazen et al.
4,359,163 A 11/1982 Ratti
4,535,897 A 8/1985 Remington et al.
4,938,369 A 7/1990 Carilli
4,971,209 A 11/1990 Todd
5,024,705 A 6/1991 Cahill
5,025,936 A 6/1991 Lamoureaux
5,036,989 A 8/1991 Carilli
5,147,038 A 9/1992 Pergeau
5,148,919 A 9/1992 Rubin
5,579,929 A 12/1996 Schwartz
5,664,689 A 9/1997 Mirlisena, Sr.
6,079,559 A * 6/2000 Lee ..... 206/378

* cited by examiner

*Primary Examiner*—Sarah Purol
(74) *Attorney, Agent, or Firm*—Price, Heneveld, Cooper, DeWitt & Litton, LLP

(57) ABSTRACT

A tool holder assembly of the present invention that includes a main tool holder body having an inner section and an outer section that may be one or more pieces. The inner section comprises at least one inner section tool receiving aperture and the outer section comprises at least two outer section tool receiving apertures that both substantially align with the inner section tool receiving apertures and the inner and outer sections form an elongated insert receiving space and a removable, elongated, elastomeric insert optionally spaced within the elongated insert receiving space. The insert comprises an insert tool receiving aperture that substantially aligns with the inner and outer section tool receiving apertures such that tools of various shapes are substantially retained by the tool holder assembly when a tool is placed within the tool receiving apertures of the inner section, the outer section, and the insert.

29 Claims, 9 Drawing Sheets

TOOL HOLDER

CROSS-REFERENCE TO RELATED APPLICATIONS

The present application claims the benefit of U.S. Provisional Application No. 60/438,654 filed on Jan. 8, 2003, the entire contents of which are incorporated by reference.

BACKGROUND OF THE INVENTION

The present invention generally relates to a removable tool holder and more particularly to a portable removable tool holding attachment that optionally lockingly interfits with a bottle holder device or other suitable surface such as a wall, cabinet wall, side of a tool chest, vehicle surface or the like.

Occasionally, workers in specialized fields spend a large amount of money purchasing tools specific to their trade. Unfortunately, these valuable tools, when used at a job site or in an open work environment, are susceptible to thievery due to the open and easy access of the tools in these environments. Exacerbating the problem is the desire to have these tools available on a daily basis at a work site. Currently, in order to secure valuable tools overnight or when otherwise not in use at a job site, a worker typically removes the tools from their location where they are readily accessible and locks them in either a toolbox, drawer, or other secure location. This also has adverse effects because a worker may want to transport his/her tools home for his/her own personal use during the evening or on the weekends or merely to assure their safety. However, this is not practical when there is no readily available means to hold and transport the tools.

Accordingly, there is a need for a secure, readily removable, easily manufactured, relatively lightweight, and inexpensive apparatus to retain various tools of various shapes.

SUMMARY OF THE INVENTION

An embodiment of a tool holder assembly of the present invention includes a main tool holder body having an inner section and an outer section that may be one or more pieces wherein the inner section comprises at least one inner section tool receiving aperture and the outer section comprises at least two outer section tool receiving apertures that both substantially align with the inner section tool receiving apertures and the inner and outer sections form an elongated insert receiving space and a removable, elongated, elastomeric insert optionally spaced within the elongated insert receiving space, wherein the insert comprises an insert tool receiving aperture that substantially aligns with the inner and outer section tool receiving apertures such that tools of various shapes are substantially retained by the tool holder assembly when a tool is placed within the tool receiving apertures of the inner section, the outer section, and the insert.

These and other features, advantages, and objects of the present invention will be further understood and appreciated by those skilled in the art by reference to the following specification, claims, and appended drawings.

BRIEF DESCRIPTION OF THE DRAWINGS

FIG. 18 is a perspective view showing a tool holder according to another aspect of the present invention mounted on a bottle holding device;

DETAILED DESCRIPTION OF PREFERRED EMBODIMENT

Figure 1:
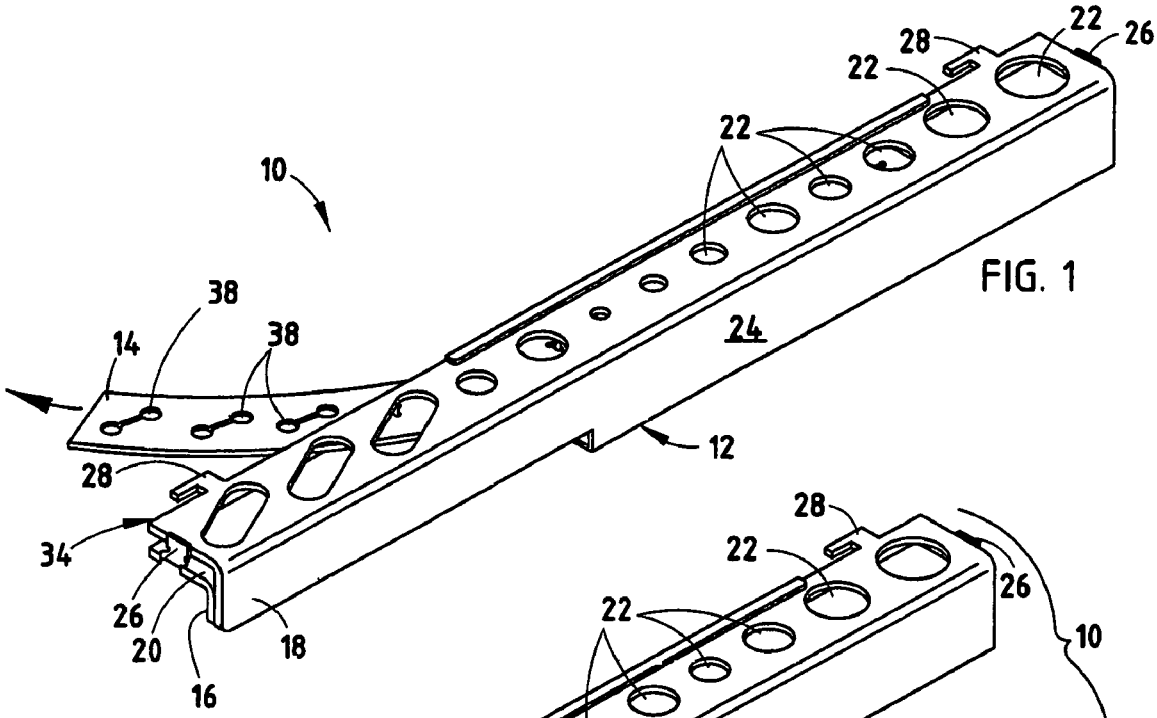
FIG. 1 is a perspective view of a tool holder in accordance with the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

FIG. 1 shows a typical tool holder 10 of the present invention, including a main tool holder body 12 and removable insert 14. The main tool holder body 12 typically includes an inner section 16 and an outer section 18 having a top portion 7, a bottom portion 8, and a front portion 9. Typically, the inner section 16 and the outer section 18 are two components; however, one could also construct a main tool holder body 12 from one component or more than two components, so long as the main tool holder body includes an elongated insert receiving space 20. Typically, the main tool holder body 12 is constructed from metal or other similar durable material. The main tool holder body 12 could also be injection molded. Furthermore, as seen in FIGS. 1–8, inner section 16 and outer section 18 are constructed such that the tool receiving apertures 22 substantially align.

Typically, the tool receiving apertures 22 in the outer section 18 have a slightly smaller size/diameter than the tool receiving apertures 22 of the inner section 16. Although a variety of configurations could be utilized, in the illustrated example the apertures 22 in inner section 16 are nominally 0.070 inches larger, with a tolerance of +0.025 and −0.010. Thus, the larger apertures 22 are always at least 0.035 inches larger in diameter (and length if oval). This facilitates insertion retention of the tools when inserted into the tool receiving apertures of the main tool body 12 and the insert 14. However, the tool holder will function when the tool receiving apertures are the same size and may function even if the diameter of the inner section tool receiving apertures are smaller than the diameter of the tool receiving apertures of the outer section, but this is not typical. The round openings 22 may have a diameter that is slightly larger than the standard shaft diameters of counter bores, reamers or the like such that the shafts of the counter bores and reamers can be inserted into openings 22 with the heads of the reamers and counterbores in contact with the upper surface of outer section 18 to further retain the tools. Typically, when the inner and outer sections are two metal components, the inner section 16 is bent slightly over the top of the outer section 18 and the inner and outer sections are typically spot welded 25 to one another along the front surface of the main tool holder body front surface 24. Optionally, the inner section 16 or the outer section 18 may further include insert retaining tabs 26 that are typically centered but could be spaced at any suitable location along each end of the tool holder 10.

The outer section 18 also typically includes two sliding L-shaped retaining members or hooks 28 and a locking tab 30, which operate to retain and lock the tool holder in place on any surface with corresponding L-shaped retaining member receiving apertures or grooves, such as shown in FIGS. 9–12. A tab 47 includes an opening 48 that aligns with an opening 49 in bottle holder 42. A threaded fastener or the like may be inserted through openings 48 and 49 to thereby "permanently" attach tool holder 10 to bottle holder 42.

The insert 14 is typically made of rubber or a rubber-like material, such as neoprene. Neoprene is a synthetic rubber made by the polymerization of chloroprene, characterized by superior resistance (as to oils) and elongation with a durometer rating of about 40–60 and used for gaskets, special-purpose clothing (as gloves and wetsuits), or the like. Advantageously, this material also returns to its original shape after being deformed. It will be readily apparent that although these properties of neoprene are advantageous, a wide variety of flexible materials could be utilized to make the insert 14.

Figure 2:
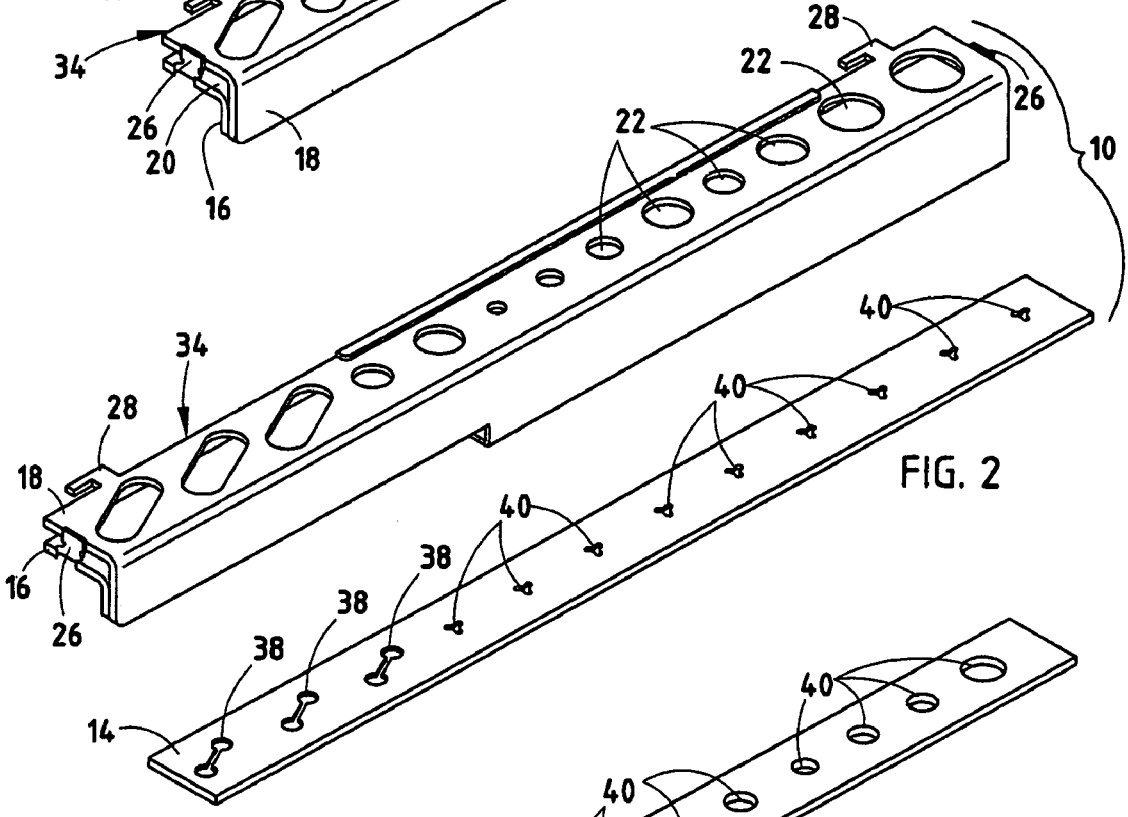
FIG. 2 is a perspective view of the main tool holder body and an insert separated from one another.
Figure 3:
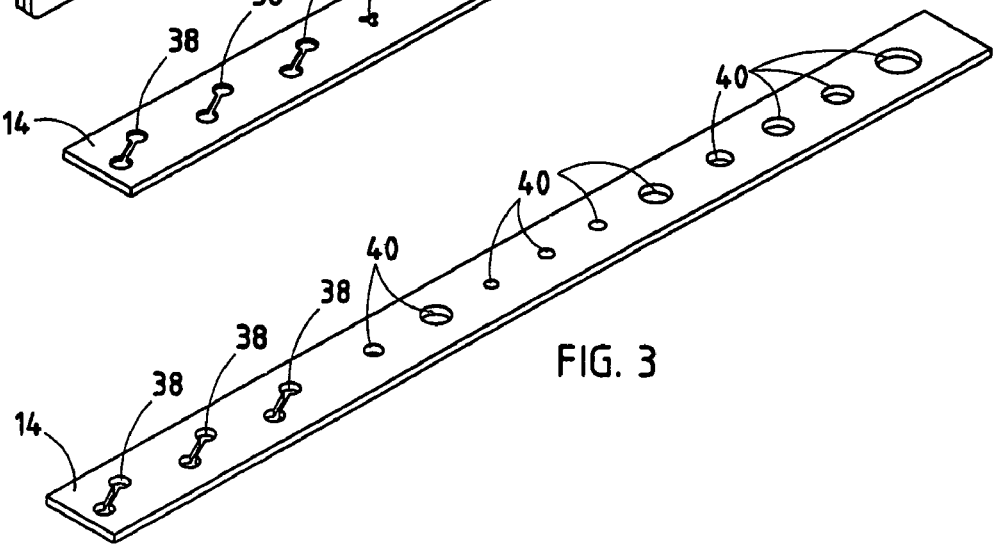
FIG. 3 is a perspective view of an alternative insert for use in another embodiment of the present invention.
Figure 4:
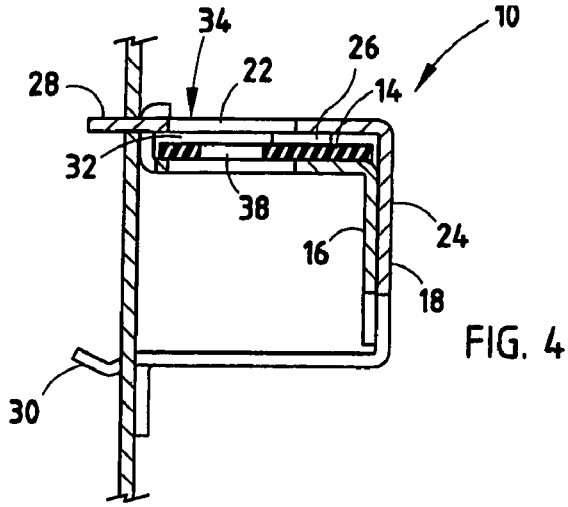
FIG. 4 is a cross-sectional view of the tool holder and insert construction taken along the line IV—IV, FIG. 9, showing the insert within the insert retaining space defined by the outer and inner sections of the main tool body.
Figure 5:
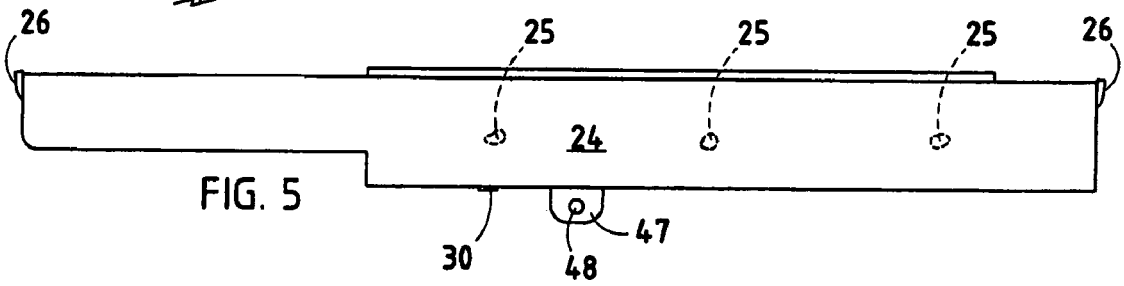
FIG. 5 is an elevated front view of an embodiment of the main tool holder body of an embodiment of the present invention.
Figure 6:
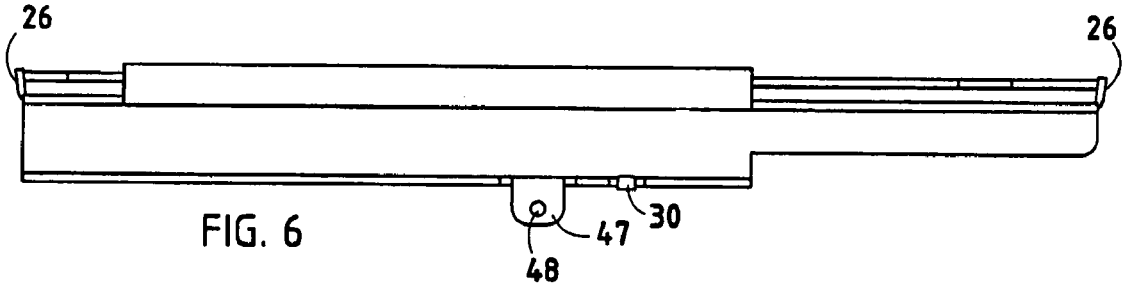
FIG. 6 is an elevated view of the rear of an embodiment of the main tool holder body of an embodiment of the present invention.
Figure 7:
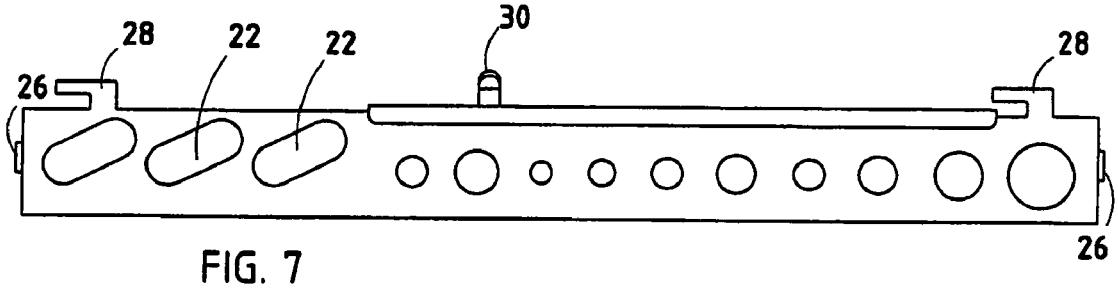
FIG. 7 is a top view of an embodiment of the main tool holder body of the present invention.
Figure 8:
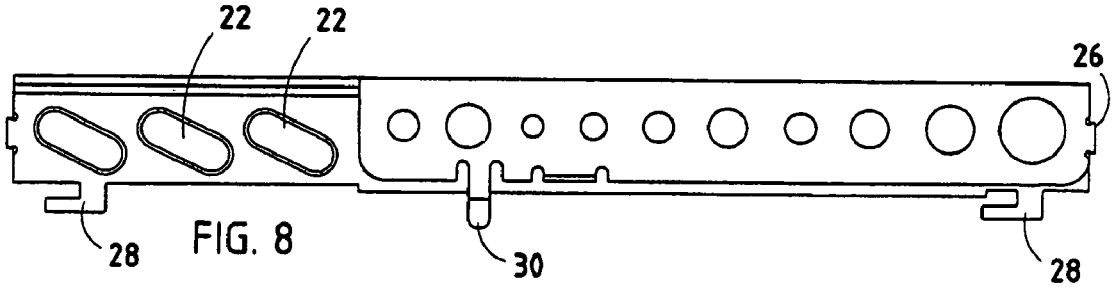
FIG. 8 is a bottom view of an embodiment of the main tool holder body of the present invention.

As shown in FIGS. 2–3, insert 14 may be constructed to have various shaped tool receiving apertures, where the design of the tool receiving apertures in the insert may vary, depending on the tool(s) to be retained. Typically, the insert receiving space 20 is large enough such that when the insert 14 is spaced within the insert receiving space 20, there is a free play space 32 of about 0.1 to about 0.25 inches. Furthermore, the distance Y from the insert receiving end 34 of the main tool holder body 12 is typically about 4.5 inches. This distance facilitates easy insertion and removal of the various inserts 14, but also retains the insert in the insert receiving space.

The oval-shaped tool receiving apertures 22 of the main tool holder body 12 typically correspond to barbell-like shaped tool receiving apertures 36 in the insert 14. This barbell-like shape is designed to hold a wide variety of items having a non-circular and/or irregular shape such as large and small pliers with lager bolts on their side. Apertures 36 can also be used to hold socket wrenches, socket head screwdrivers, or other such items. As the pliers are inserted, the neoprene moves inward around the side of the object to firmly hold the tool, while not gripping the tool too tightly. Lastly, the 3-leaf clover-like substantially triangular tool receiving apertures 40 in the insert 14 are typically used to retain screwdrivers and other similar elongated substantially cylindrical-shaped tools. The primarily circular tool receiving apertures 38 in the insert 14 are typically used to retain somewhat larger substantially cylindrical-shaped tools, such as counterbores, reamers or other items such as flashlights, socket heads, or the like. The insert 14 prevents the tools from vibrating while being transported while on a tool or mounted on a vehicle or other surface. In addition to those tools noted above, tool holder body 14 may also be mounted in a boat and used to hold a wide variety of fishing equipment such as bobbers, fillet knives, hook removers, long nose pliers, lures, drain plug, car keys or the like. The metal components may be made of a stainless steel material for this application.

Figure 9:
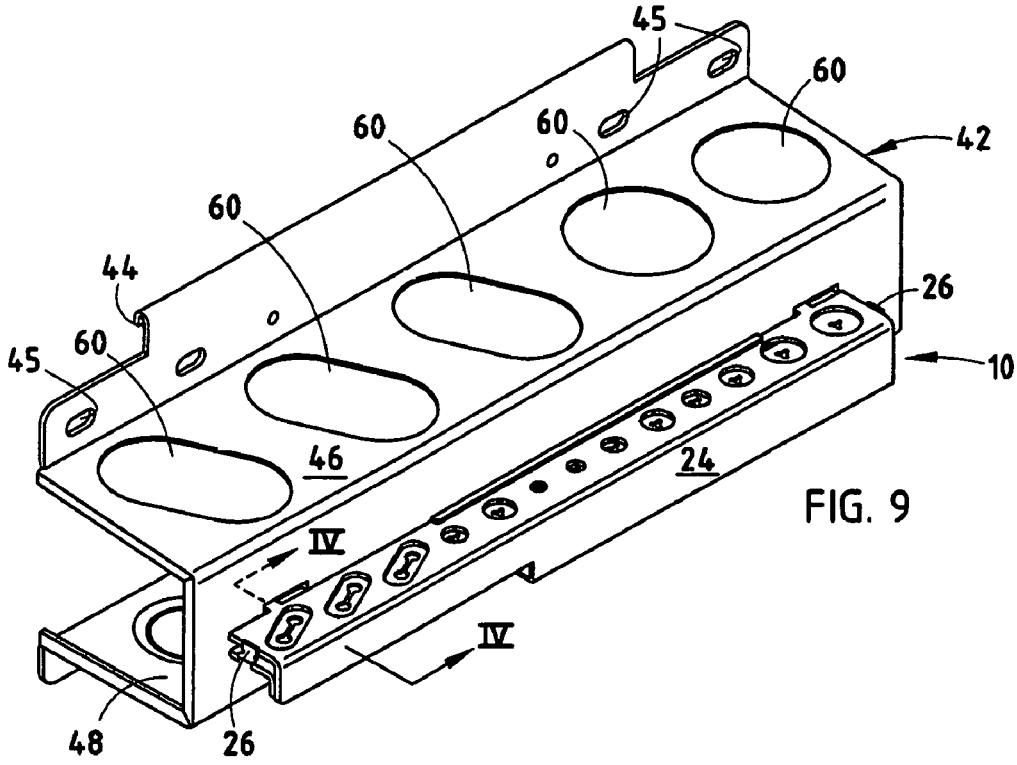
FIG. 9 is a perspective view showing a tool holder of the present invention mounted on a bottle holding device.
Figure 10:
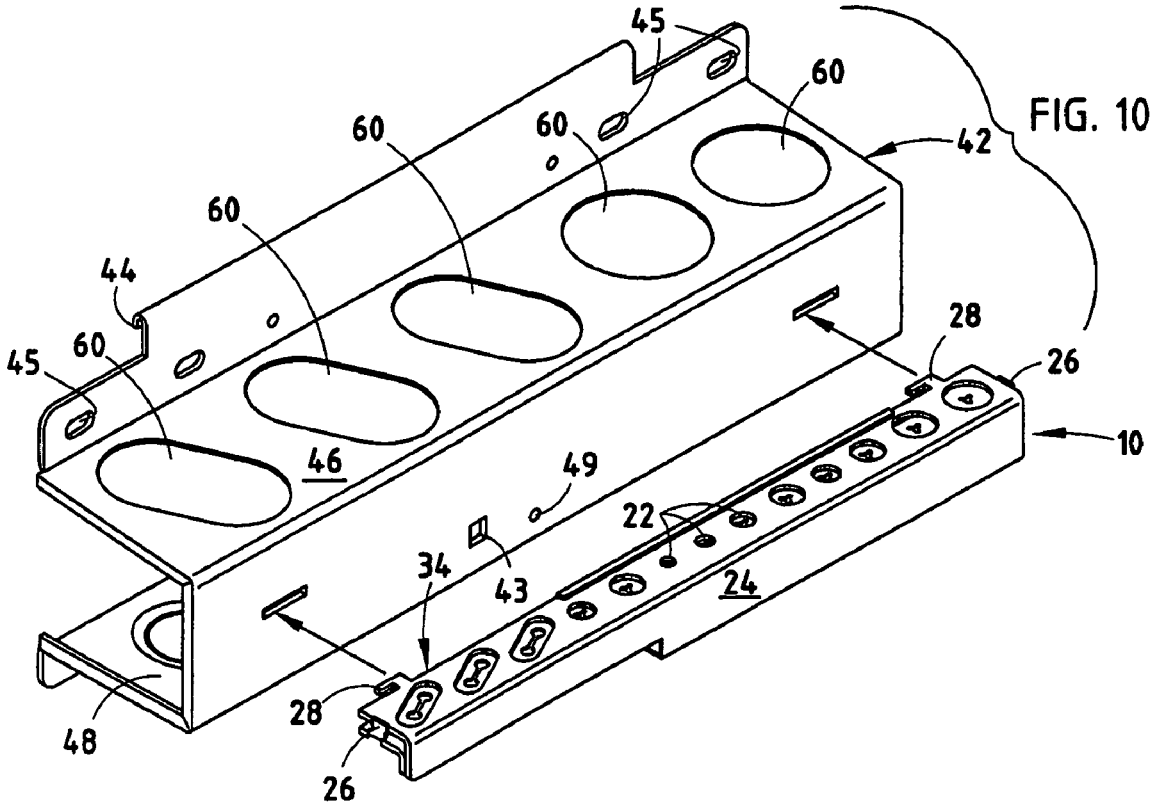
FIG. 10 is a partial exploded view showing a tool holder of the present invention removed from a bottle holding device.
Figure 11:
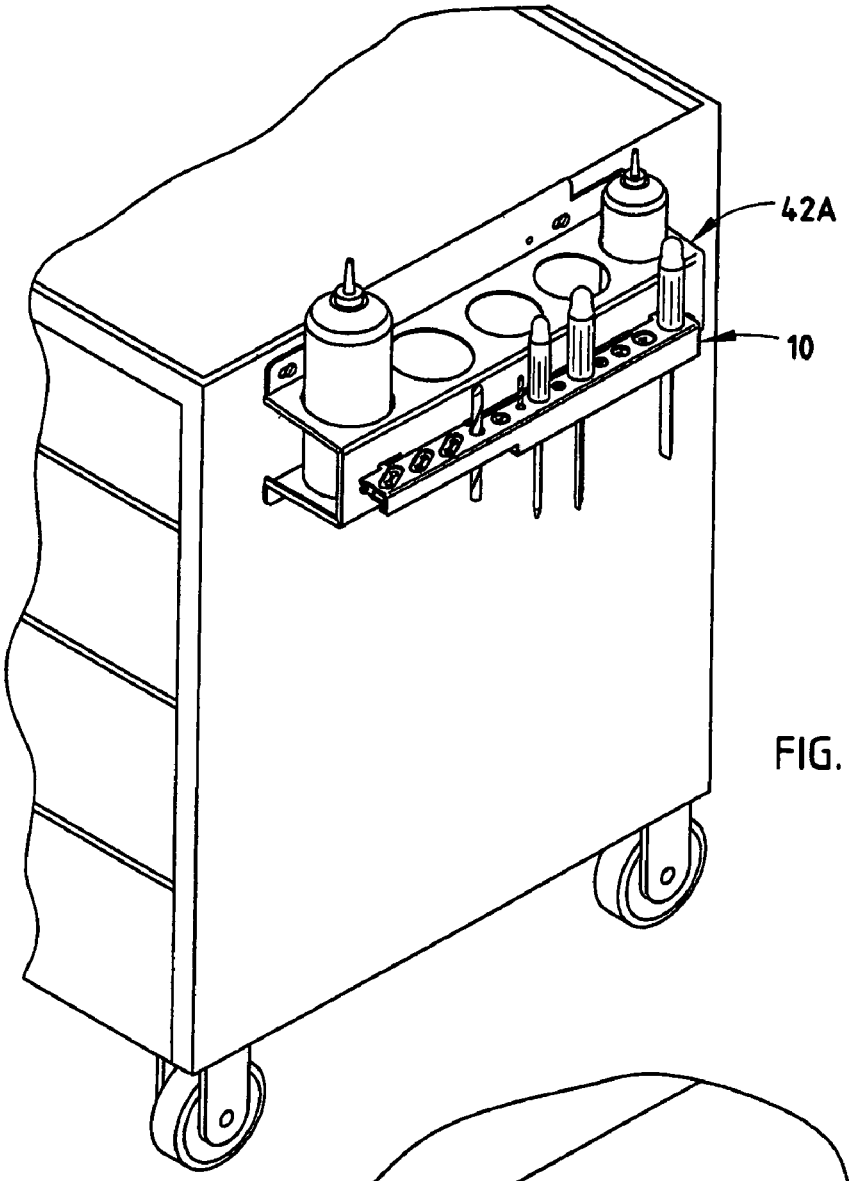
FIG. 11 is a perspective view showing a tool holder of the present invention engaged to the bottle holding device, wherein the bottle holder is attached to a tool cart.
Figure 12:
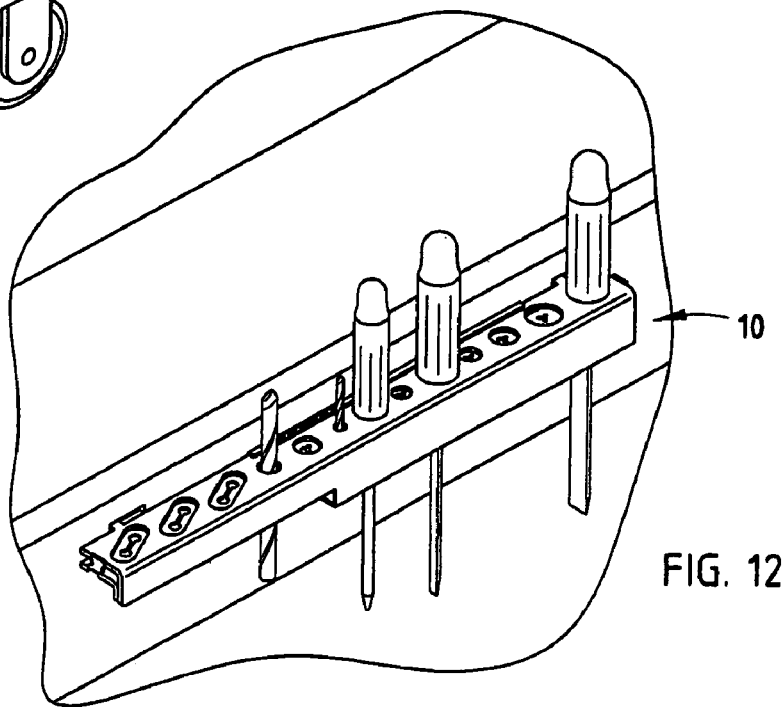
FIG. 12 is a perspective view showing a tool holder of the present invention attached to any other suitable substrate surface, such as the interior of a utility van or other surface.
Figure 13:
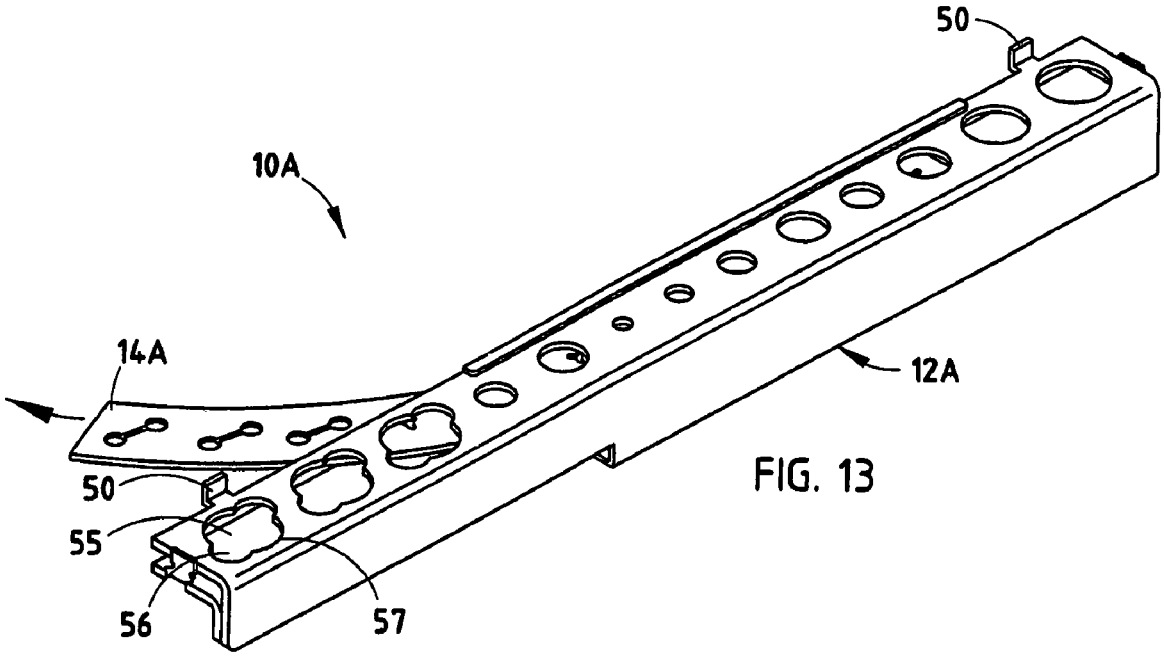
FIG. 13 is a perspective view of a tool holder according to another aspect of the present invention.
Figure 14:
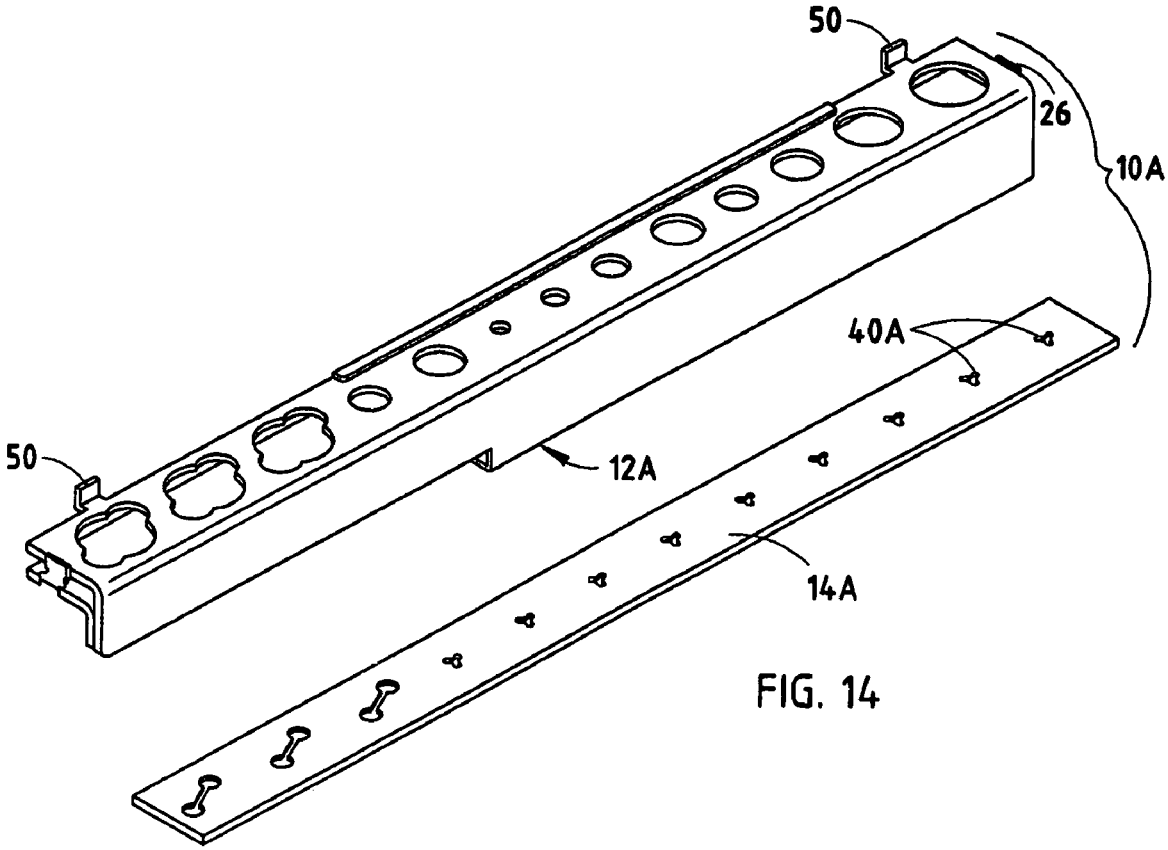
FIG. 14 is a perspective view of the main tool holder body and insert of FIG. 13 separated from one another.
Figure 15:
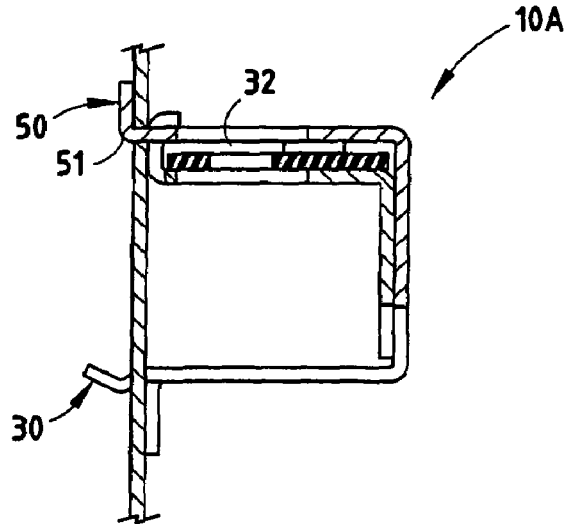
FIG. 15 is a cross-sectional view of the tool holder and insert construction taken along the line XV—XV.
Figure 16:
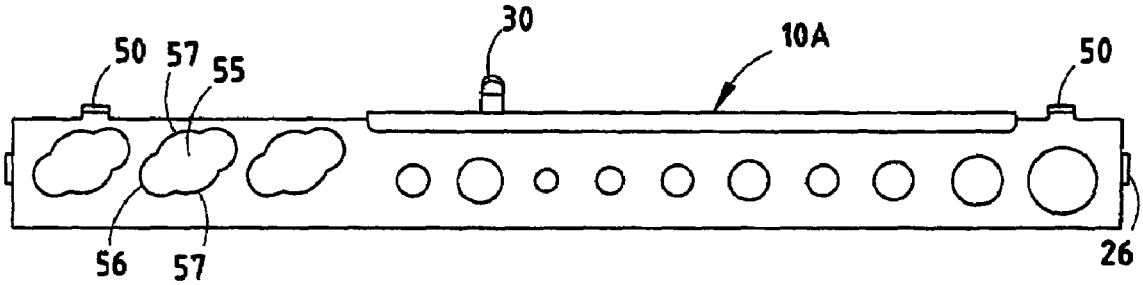
FIG. 16 is a top view of the main tool holder body of FIG. 13.
Figure 17:
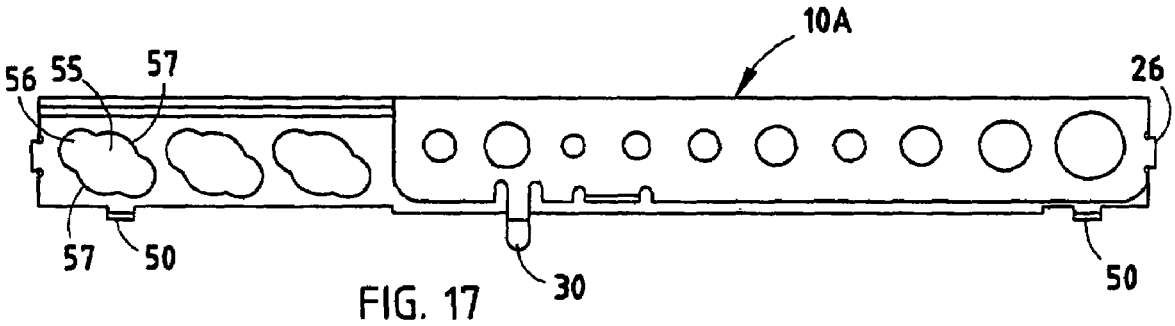
FIG. 17 is a bottom view of the main tool holder body of FIG. 13.

As shown in FIGS. 9–10, the tool holder 10 may be mounted using the L-shaped retaining members 28 and locking tab 30 to any surface. One such surface is a bottle holding apparatus 42. The locking tab 30 mates with a locking tab receiving aperture 43 once the L-shaped retaining members 28 are spaced within grooves 46, slid in the correct retaining direction (in the case of FIG. 10, to the left), and the tool holder 10 is pushed down, thereby frictionally forcing the locking tab 30 into the locking tab receiving aperture 43. The locking tab 30 typically has an arched shape or bump to facilitate retention of the locking tab 30 in the locking tab receiving aperture 43.

As discussed above, the tool holder 10 may be mounted in a similar fashion to any suitable surface, including the interior of a vehicle or any surface of a toolbox. Conceivably, the tool holder could even be mounted on a building (shop) wall. The tool holder 10 can be mounted to any surface to allow the tool user ready access to his/her tools.

At the end of the day, an operator may remove the entire tool holder, with or without the tools inserted therein, from its mounting surface at a job site, and place the tool holder in a secure location, or may transport the tool holder and tools to the operator's home for safekeeping until needed.

A tool holder of the present invention may be used alone or with another holding device, such as bottle holding apparatus 42. Bottle holding apparatus 42 may be mounted on any surface with a fastener, typically a screw, and/or may have a U-shaped channel 44 that fits over the edge of a surface (such as the edge of a toolbox or cart) to suspend the apparatus 42. When a screw or other fastener is utilized, the fastener(s) is (are) typically spaced within one or more fastener receiving apertures 45. Typically, the apparatus 42 has a top shelf 46 and a bottom shelf 48. The top shelf 46 typically includes apertures of various diameters 60 to receive any size bottle or other container or device. Also, shelf 46 may be sloped downwardly such that water, cleaning solutions, lubricants or the like run off shelf 46. The apparatus 42 is typically made of metal or other similar material. The apparatus 42 could also be injection molded.

With further reference to FIGS. 13–17, a tool holder 10A according to another aspect of the present invention includes a main tool holder body 12A and an insert 14A. Tool holder 10A includes upwardly extending tabs 50 that are received in openings 51 of a bottle holder 42B (see also FIG. 20). The tool holder 10A may be installed to a bottle holder 42B by inserting the tabs 50 into openings 51. The tool holder 10A is then shifted horizontally (i.e., to the left in FIG. 20) such that the tabs 50 engage the end portions 53 of openings 51. The tool holder 10A is then rotated downwardly, until the locking tab 30 (FIG. 15) is received in opening 52 of bottle holder 42A to thereby retain the tool holder 10A in position. The attachment tabs 50 and the L-shaped retaining members 28 both permit installation and/or removal of the tool holders 10A and 10, respectively, from the bottle carriers 42–42C while tools are being held by the tool holders 10A and 10.

The main tool holder body 12A includes a plurality of openings 55, each of which includes an elongated portion 56 that is substantially the same as the openings 22 in the tool holder of FIG. 1. However, openings 55 further include radiused portions 57 extending transverse to the elongated portion 56. The shape of the openings 55 thereby permits a large variety of items such as a wrench, pliers, scissors, or other such tools or objects having a variety of sizes and shapes to be inserted into openings 55. The insert 14A is similar to the insert 14 described in more detail above, except that openings 40A in insert 14A are somewhat larger to accommodate a wider range of tools or other objects. The inserts 14 and 14A keep the tools or other objects from vibrating or rattling while moving or otherwise transporting the tool holder on a tool chest, vehicle, or the like. Also, the insert 14A holds the tools or other such objects in a secure manner, yet also permits the tools to be readily removed from the tool holder for use.

Figure 18:
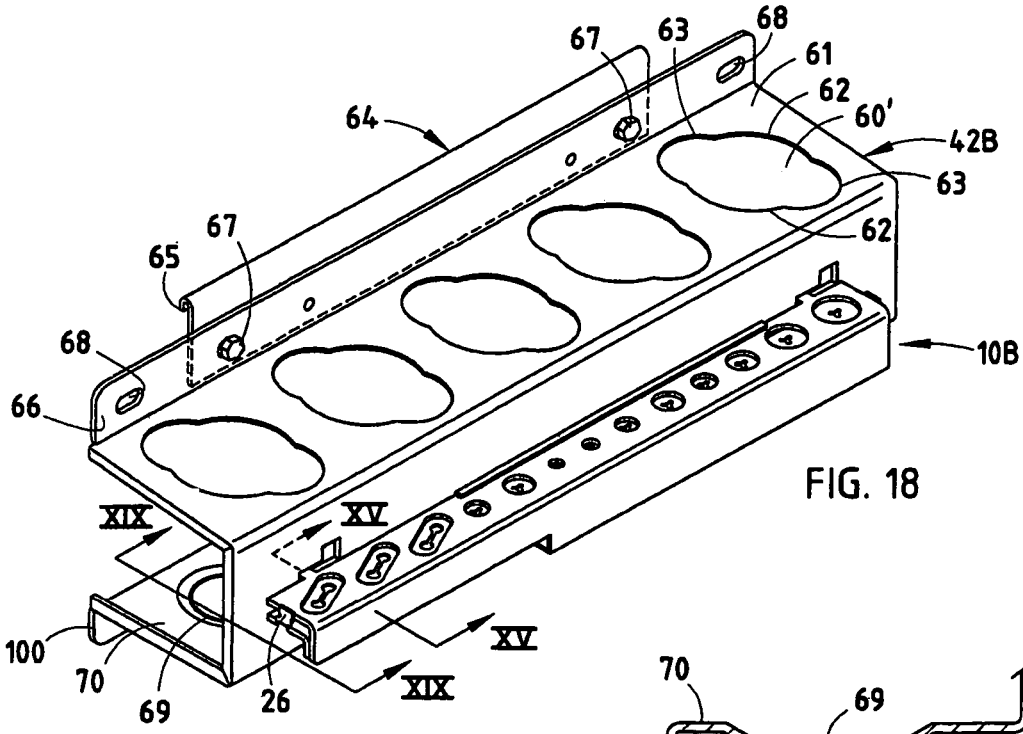
FIG. 18.
Figure 19:
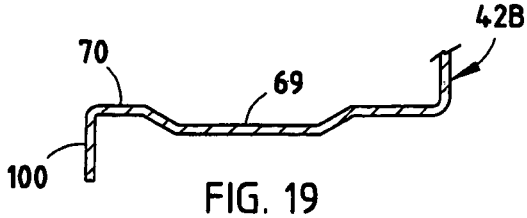
FIG. 19 is a partial cross-sectional view taken along the line XIX—XIX.
Figure 20:
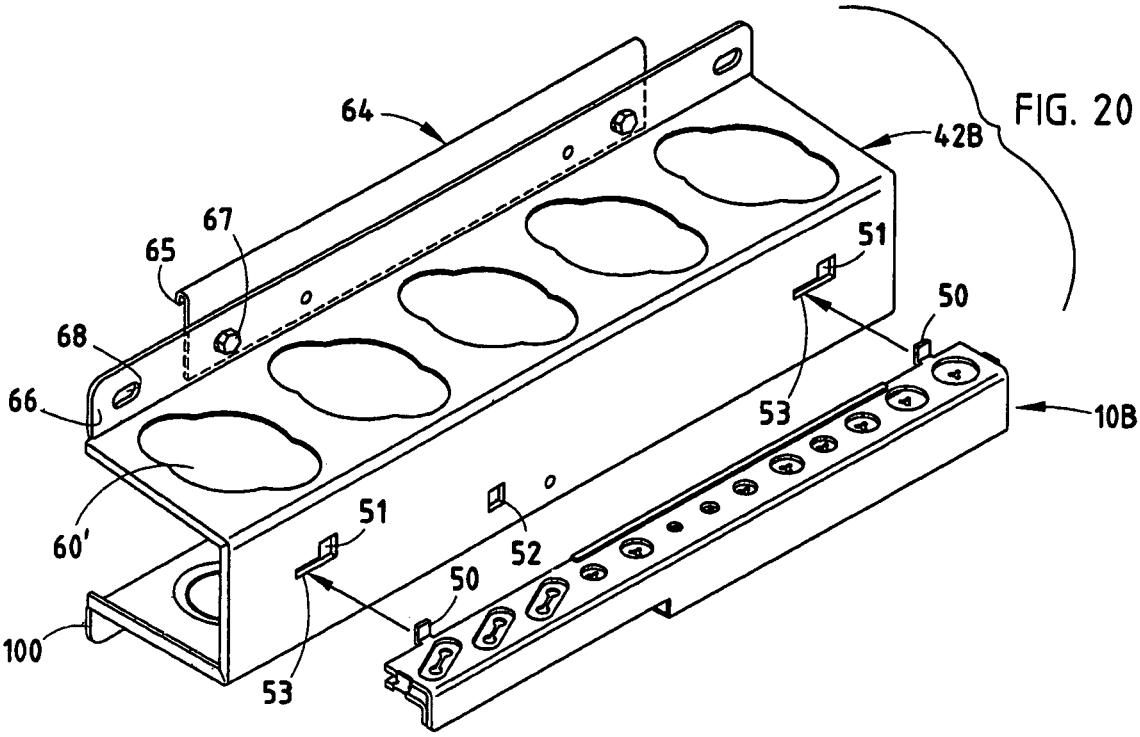
FIG. 20 is a perspective view of the tool holder detached from the bottle holding device.

With further reference to FIGS. 18–20, the tool holder 10B may be mounted to a bottle holder 42B having a plurality of openings 60' in an upper sidewall 61. The openings 60' are somewhat similar to the openings 60 in FIGS. 9–10, and include circular edge portions 62. However, unlike the openings 60 described above, the openings 60' further include elongated elliptical portions 63. The elliptical portions 63 permit bottles having an oblong cross-sectional shape to be received in the openings 60', while also permitting retention of bottles having a circular cross-sectional shape. A flange member 64 includes a downwardly extending flange 65 forming a hanger for mounting the bottle holder 42B to the edge of a tool chest or the like. The flange member 64 may be secured to the upwardly extending flange 66 of bottle holder 42B via bolts 67 or the like. Alternately, the bottle holder 42B can be mounted directly to a vertical surface in a vehicle, a building wall, or the like by removing the flange member 64. Threaded fasteners or the like may then be inserted through the openings 68 in flanges 66 and 100 to secure the bottle holder 42B to the vertical surface. Flanges 66 and 100 may be angled somewhat, at, for example, three degrees from vertical, such that the outer edges of flanges 66 and 100 first contact the vertical mounting surface during installation. As the fasteners in openings 68 are tightened, flanges 66 and 100 flex, thereby ensuring the edges of flanges 66 and 100 tightly about the mounting surface.

A depression 69 may be formed in the lower wall 70 of bottle holder 42B to vertically position the bottles or the like positioned in the openings 60'. The depression 69 may have a shallow, circular shape, or may be oblong to correspond to the shape of the openings 60'. In this way, bottles or the like positioned in the bottle holder 42B are retained in the upright position.

Figure 21:
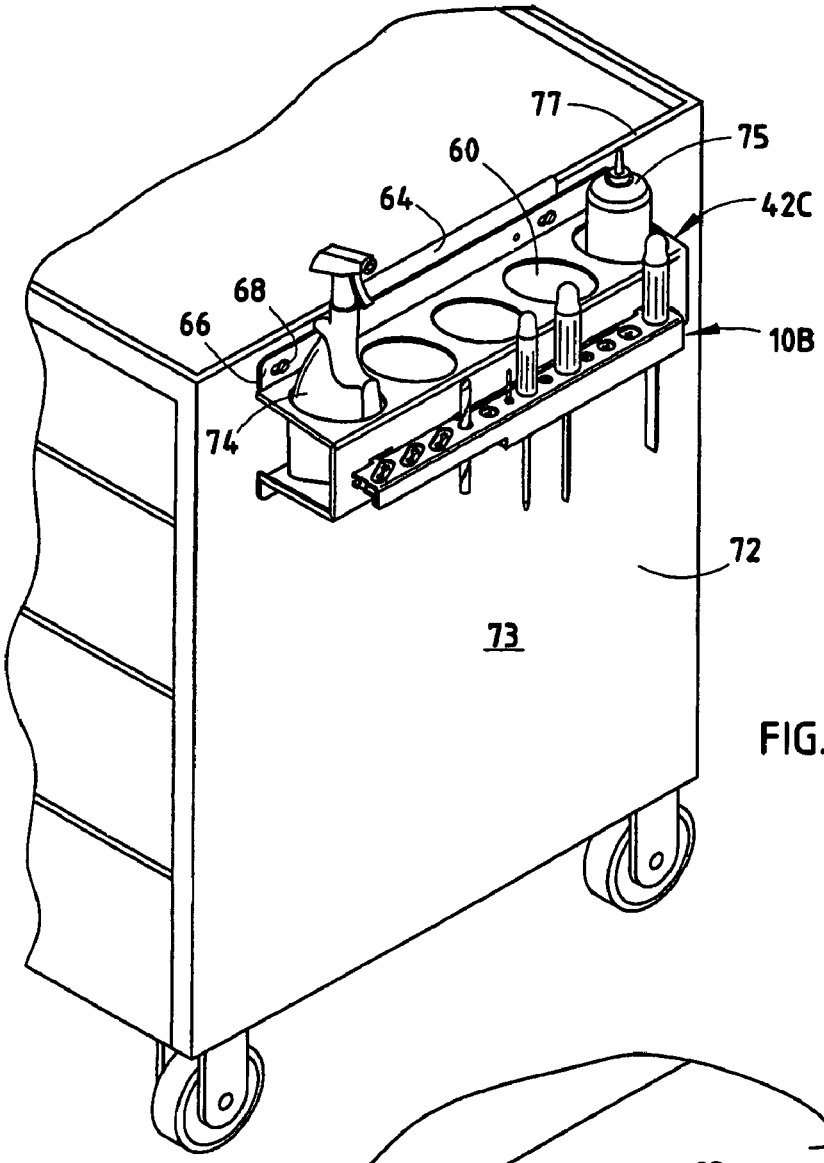
FIG. 21 is a perspective view showing a tool holder according to another aspect of the present invention engaged to the bottle holding device, wherein the bottle holder is attached to a tool cart.

With further reference to FIG. 21, the bottle holder 42C and tool holder 10A may be mounted to an upper edge 77 of toolbox 72 via flange member 64. Alternately, the bottle holder 42C may be secured directly to the vertical side surface 73 of toolbox 72 by detaching the flange member 64 and inserting threaded fasteners or the like through openings 68 in flange 66 of bottle holder 42C. As discussed above, the oblong shape of the openings 60' permits them to receive bottles 74 having an oblong cross-sectional shape, or bottles 75 having a circular cross-sectional shape.

Figure 22:
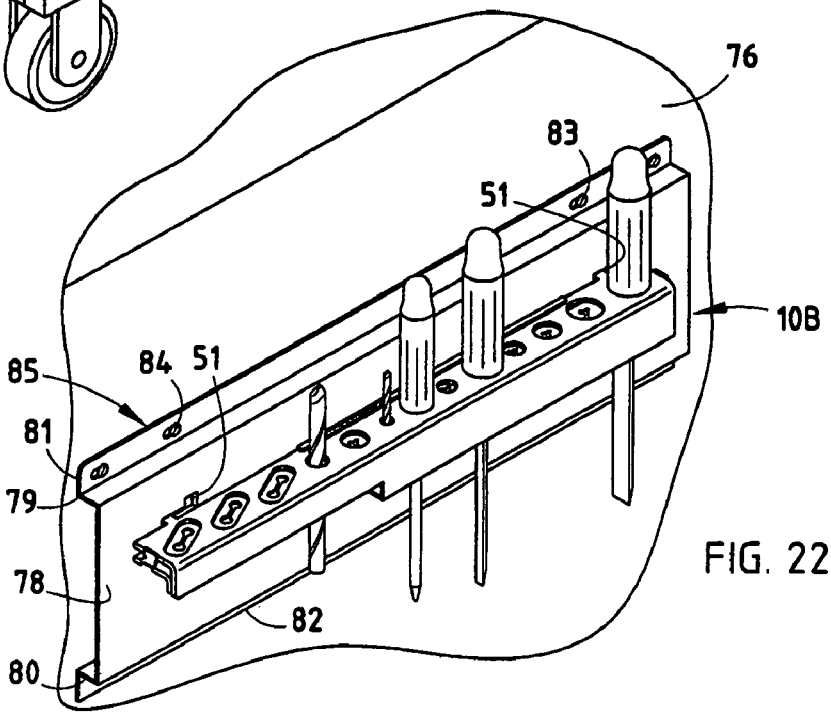
FIG. 22 is a perspective view showing a tool holder attached to a vertical wall surface or the like utilizing a channel bracket.

With further reference to FIG. 22, tool holder 10A may be mounted to a wide variety of vertical surfaces 76 utilizing a channel bracket 85. Bracket 85 has a generally hat-shaped cross-sectional configuration with a main vertical wall portion 78, upper and lower inwardly extending flanges 79 and 80, respectively, an upwardly extending flange 81, and a downwardly extending flange 82. A plurality of openings 83 in flanges 81 and 82 receive threaded fasteners 84 or the like to thereby secure the tool holder 10B to a variety of vertical surfaces 76. The vertical wall 78 of bracket 85 includes openings 51 and 52 to thereby permit the tool holder 10A to be mounted to bracket 85 in substantially the same manner as described in connection with the bottle holder 42B (FIG. 20).

Figure 23:
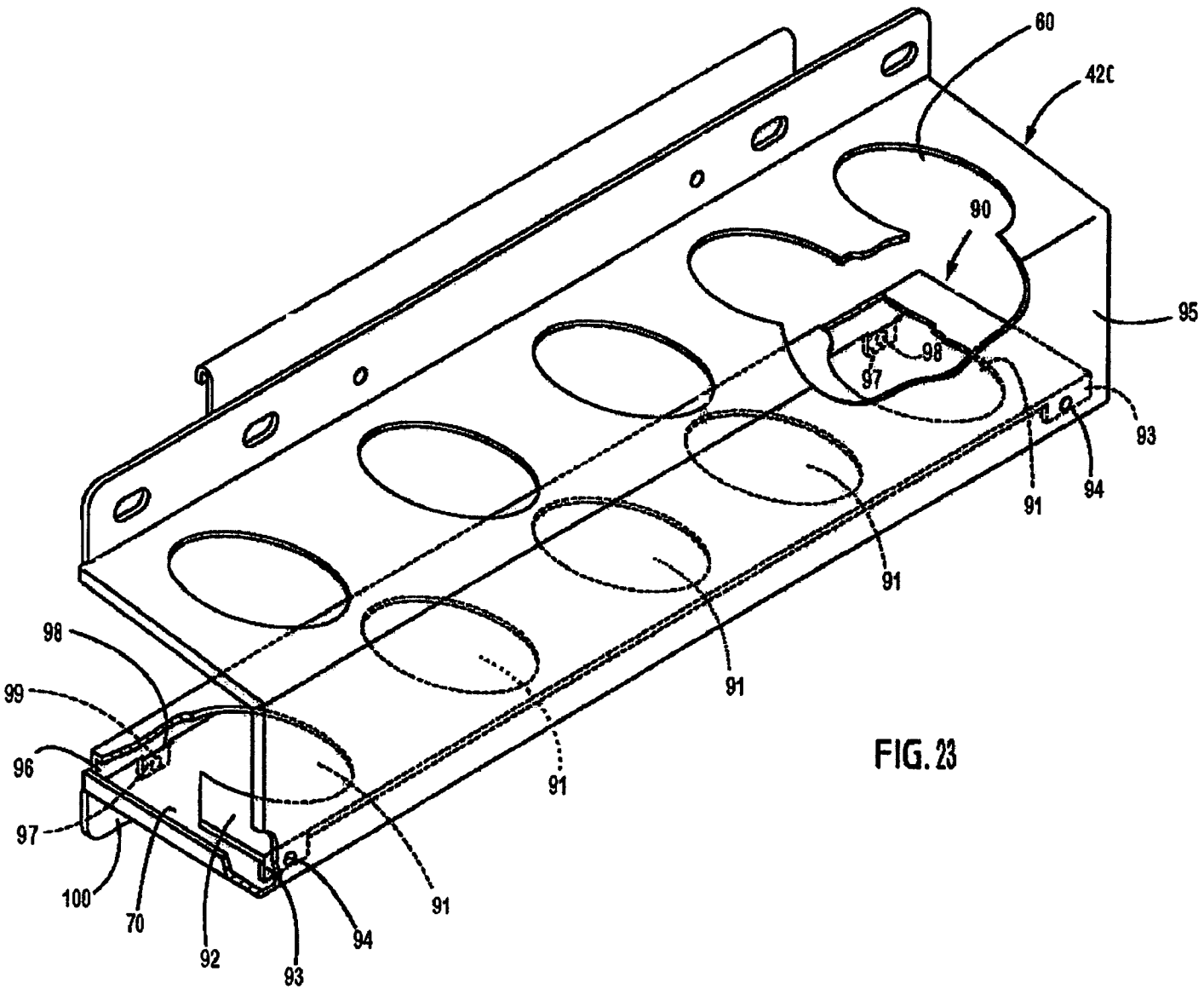
FIG. 23 is a perspective view of an insert for the bottle holder.

With further reference to FIG. 23, bottle holder 42C may include an insert 90 having a plurality of openings 91, each of which has the same size and shape as the openings 60 of bottle holder 42C. Openings 60 and 91 may be circular, or they could have an elliptical shape that is the same as apertures 60 (FIGS. 9 and 10). Holes 60 and 91 could also include radiused portions to form the same shape as openings 60' of FIGS. 18 and 20. The insert 90 generally comprises a web or wall 92 and a pair of downwardly extending front tabs 93 that are spot welded at 94 to the front wall 95 of bottle holder 42C. Insert 90 also includes a downwardly extending rear flange 96 that extends along the entire rear edge of the insert 90. A pair of downwardly extending tabs 97 extend from flange 96 through openings 98 in the bottom wall 70 of bottle holder 42C. The tabs 97 may be spot welded to the downwardly extending lower flange 100 at 99 to further secure the insert 90 to the bottle holder 42C. The web 92 of insert 90 is spaced upwardly from the bottom wall 70 of bottle holder 42C, such that bottles positioned in the openings 60 and 91 are thereby retained in an upright position.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A tool holder, comprising:

a main tool holder body including an inner section and an outer section, wherein the inner section comprises at least two inner tool receiving apertures and the outer section comprises at least two outer tool receiving apertures that substantially align with the inner tool receiving apertures and wherein the inner and outer sections form an insert receiving space comprising a thickness defined by the outer section facing surface of the inner section and the inner section facing surface of the outer section; and a flexible insert disposed within the insert receiving space and having a thickness less than the thickness of the insert receiving section thereby defining a free play space within the insert receiving space, wherein the insert comprises an insert tool receiving aperture that substantially aligns with the inner and outer tool receiving apertures such that tools of various shapes are substantially retained by the tool holder assembly when a tool is placed within the tool receiving apertures of the inner section, the outer section, and the insert.

2. The tool holder of claim 1, wherein:

the two outer tool receiving apertures define a perimeter formed by an edge of the apertures, and:

the insert tool receiving aperture is defined at least in part by edge portions that extend inwardly beyond the edges of the outer tool receiving apertures.

3. The tool holder of claim 1, wherein:

the insert comprises an elastomeric material and is removable from the insert receiving space, the inner and outer sections comprise a metal material.

4. The tool holder of claim 2, wherein:

the inner and outer sections comprise elongated members, and the insert receiving space and the insert are elongated.

5. The tool holder of claim 2, wherein:

the insert tool receiving aperture comprises of first aperture having a first shape, and wherein:

the insert includes a second aperture having a second shape that is substantially different than the first shape.

6. The tool holder of claim 1, wherein:

the insert tool receiving aperture defines an edge having three inwardly extending flaps.

7. The tool holder of claim 1, wherein:

the insert tool receiving aperture defines an edge having generally parallel center portions and enlarged circular end portions.

8. The tool holder of claim 1, wherein:

at least one of the outer tool receiving apertures has an oblong shape defining an axis.

9. The tool holder of claim 8, wherein:

the at least one outer tool receiving aperture includes portions that extend transverse to the axis.

10. A combination bottle holder and tool holder, comprising:

a support structure having a first portion defining a generally horizontal upper web having a plurality of bottle-receiving openings therethrough, wherein at least one bottle receiving opening comprises circular edge portions and elongated elliptical portions enabling bottles having a circular cross-section and bottles having an oblong cross-section to be spaced within the bottle receiving openings, the support structure further including supports below the bottle-receiving opening;

the support structure further including a second portion configured to support tools, the second portion including at least one upwardly open tool-receiving aperture; and a flexible member having at least two opposed flap portions adjacent the tool-receiving aperture for retaining tools.

11. The combination bottle holder and tool holder of claim 10, wherein:

the second portion of the support structure is detachably connected to the first portion of the support structure.

12. The combination bottle holder and tool holder of claim 10, wherein:

the second portion of the support structure includes generally parallel upper and lower webs that are spaced apart to form a cavity therebetween, wherein the cavity has a thickness defined by the lower web facing surface of the upper web and the upper web facing surface of the lower web, and wherein the flexible member is disposed in the cavity, and wherein the flexible member has a thickness less than the thickness of the cavity thereby defining a free play space within the cavity.

13. The combination bottle holder and tool holder of claim 12, wherein:

the first portion of the support structure includes vertically spaced apart upper and lower webs, and wherein the bottle receiving openings are through the upper web.

14. The combination bottle holder and tool holder of claim 13, wherein:

the lower web includes a plurality of depressions positioned below the bottle receiving openings.

15. The combination bottle holder and tool holder of claim 13, wherein:

the support structure includes an intermediate web positioned between the upper and lower webs and having a plurality of openings that are vertically aligned with the bottle receiving openings in the upper web.

16. The combination bottle holder and tool holder of claim 13, wherein:

the support structure includes a hanger structure for hanging the support structure on an upper edge of a vertical flange.

17. The combination bottle holder and tool holder of claim 16, wherein:

the hanger structure comprises a downwardly opening flange having a J-shape in cross section.

18. The combination bottle holder and tool holder of claim 13, wherein:

the first portion of the support structure includes a generally vertical web extending between the upper and lower webs, the vertical web having at least first and second openings therethrough; and wherein:

the second portion of the support structure includes first and second connector members extending into the first and second openings in the vertical web to releasably connect the second portion of the support structure to the first portion of the support structure.

19. The combination bottle holder and tool holder of claim 18, wherein:

the first connector member has an upwardly extending end portion received in the first opening; and the second connector comprises a flexible member having a V-shaped surface that snaps over an edge of the second opening.

20. A kit for supporting tools, comprising: a tool holder comprising a main tool holder body including an inner section and an outer section, wherein the inner section comprises at least two inner tool receiving apertures and the outer section comprises at least two outer tool receiving apertures that substantially align with the inner tool receiving apertures and wherein the inner and outer sections form an insert receiving space comprising a thickness defined by the outer section facing surface of the inner section and the inner section facing surface of the outer section, and a flexible insert disposed within the insert receiving space and having a thickness less than the thickness of the insert receiving section such that there is a free play space within the insert receiving space, wherein the insert comprises an insert tool receiving aperture that substantially aligns with the inner and outer tool receiving apertures such that tools of various shapes are substantially retained by the tool holder assembly when a tool is placed within the tool receiving apertures of the inner section, the outer section, and the insert, the tool holder having a first connecting structure;

a bracket adapted to be secured to a vertical surface;

a bottle holder having a plurality of openings for receiving bottles; and wherein:

the bracket and the bottle holder each having a second connecting structure adapted to releasably interconnect to the first connecting structure such that the tool holder can be selectively connected to the bracket and to the bottle holder.

21. The kit of claim 20, wherein:

the first connecting structure includes a member having a base portion extending in a first direction, and an end portion extending transverse to the base portion.

22. The kit of claim 21, wherein:

the second connecting structures comprise openings.

23. The kit of claim 22, wherein:

the first connecting structure includes a flexible extension having a barb adapted to engage an edge.

24. The kit of claim 23, wherein:

the tool holder includes a flexible member with portions positioned adjacent the tool-receiving openings.

25. A tool holder comprising:

a main tool holder body including an inner section and an outer section having a top portion spaced above the inner section, a bottom portion spaced beneath the inner section, and a front portion engaging the top and bottom portions and wherein the inner section comprises at least two inner tool receiving apertures and the top portion and bottom portion each comprise at least two tool receiving apertures which align with the tool receiving apertures of the inner section and wherein the inner section and top portion of the outer section form an insert receiving space;

a flexible insert disposed within the insert receiving space, wherein the insert comprises at least two insert tool receiving apertures that substantially align with the tool receiving apertures of the top portion, bottom portion, and the inner section such that tools of various shapes are substantially retained by the tool holder assembly when a tool is placed within the tool receiving apertures of the inner section, the outer section, and the insert.

26. A tool holder of claim 25, wherein:

the insert receiving space comprises a thickness defined by the top portion facing surface of the inner section and the inner section facing surface of the top portion, and the flexible insert has a thickness less than the thickness of the insert receiving section thereby defining a free play space within the insert receiving space.

27. A tool holder of claim 26, wherein:

the insert comprises an elastomeric material and is removable from the insert receiving space, the inner and outer sections comprise a metal material, and wherein the free play space is from about 0.1 to about 0.25 inches thick.

28. A tool holder of claim 25, wherein:

the bottom portion extends under a portion of the inner section.

29. A tool holder of claim 25, wherein:

at least one of the tool receiving apertures of the insert has a shape selected from the group comprising barbell and 3-leaf clover.

* * * * *